US006147614A

United States Patent [19]

Parish

[11] Patent Number: 6,147,614

[45] Date of Patent: Nov. 14, 2000

[54] BATHTUB WATER LEVEL ALARM

[76] Inventor: Dennis Hedley Parish, 3037 Champions Dr., Maryville, Tenn. 37801

[21] Appl. No.: 09/338,921

[22] Filed: Jun. 23, 1999

[51] Int. Cl.[7] ..... G08B 21/00

[52] U.S. Cl. ..... 340/623; 340/618; 340/624; 73/290 R; 73/305

[58] Field of Search ..... 340/623, 624, 340/612, 618; 73/290 R, 305, 307, 308

[56] References Cited

U.S. PATENT DOCUMENTS

| | | | |
|---|---|---|---|
| 4,080,985 | 3/1978 | Eagle | 137/429 |
| 4,258,444 | 3/1981 | Orszullok | 4/538 |
| 5,661,462 | 8/1997 | Shrewsbury-Gee | 340/618 |
| 5,894,611 | 4/1999 | Toro | 4/559 |
| 6,008,728 | 12/1999 | Wesey | 340/618 |

*Primary Examiner*—Edward Lefkowitz

[57] ABSTRACT

A bathtub water level warning device for activating an audible and/or visible warning indicator when the water level in a bathtub approximately reaches a predetermined level, comprising a watertight case including a float element, a tubular stem element and a tubular pivot element. The alarm device is an independent device which floats free of the bathtub upon the bathtub reaching a filled condition, therefore allowing removal or inclusion of the device in a bathtub as desired by a user, such as during filling only. The alarm device includes a power source, a gravity switch, and an audible and/or visible warning indicator is internally mounted in the alarm device. Gravity causes the switch to close when the alarm device is in a substantially vertical orientation. An electrical circuit connecting the power source, the gravity switch, and the warning indicator activates the warning indicator when the gravity switch is in a closed position thereby alerting the user that the predetermined water level has been approximately reached.

8 Claims, 2 Drawing Sheets

BATHTUB WATER LEVEL ALARM

BACKGROUND OF THE INVENTION

1. Field of the Invention

The present invention relates to improvements in alarm devices, particularly to a device for activating an auditory and/or visual alarm when the water level in a bathtub approximately reaches a predetermined level.

2. Description of Related Art

Those who enjoy taking baths are well aware that it generally takes a considerable amount of time to fill a bathtub. Usually, the bath taker attends to the bath as it is filled to prevent an overflow condition from occurring. This can be particularly annoying when one wishes to take a bath in the morning as he or she may not have time to wait for the tub to fill. The prior art includes many arrangements for sensing the water level of a tub or container. Some of these arrangements activate controls which close water valves, are highly complicated, and relatively expensive. Other arrangements are fixed in some manner to the bathtub or container and present an unaesthetic appearance in the bathroom.

For example, U.S. Pat. No. 2,041,549, issued on May 19, 1936 to Albin Jaeger, describes a device for sounding an alarm secured to a wall as soon as the water level in a bathtub rises above a certain predetermined level. Jaeger does not suggest an independent bathtub water level alarm according to the claimed invention.

U.S. Pat. No. 3,069,671, issued on Dec. 18, 1962 to Le Roy M. Taylor, describes a hot water heater overflow arrangement including a switch with two extended electrode rods that closes when the water level rises above the bottom of both electrode rods and transmits a signal to activate a visual or audible alarm. Taylor does not suggest a bathtub water level alarm according to the claimed invention.

U.S. Pat. No. 3,595,269, issued on Jul. 27, 1971 to Richard J. Yeagle, describes a humidifier assembly with a valving structure that holds solids concentration levels to a safe maximum. Yeagle does not suggest a bathtub water level alarm according to the claimed invention.

U.S. Pat. No. 4,258,444, issued on Mar. 31, 1981 to Willy Orszullok, describes an arrangement which includes an adjustable probe or detecting means in the form of a capacitive proximity switch which shuts off the inflow of water into a bathtub when the water level approximately reaches a predetermined level. Orszullok does not suggest a bathtub water level alarm according to the claimed invention.

U.S. Pat. No. 4,563,780, issued on Jan. 14, 1986 to Simcha Z. Pollack, describes the use of a fixed bathtub water level sensor in an automated bathroom arrangement. Pollack does not suggest a bathtub water level alarm according to the claimed invention.

U.S. Pat. No. 4,607,658, issued on Aug. 26, 1986 to Gerald M. Fraser et al., describes a bathtub water level control device which includes an air pressure tube and a regulator that controls a water flow valve and the water level in a bathtub. Fraser et al. do not suggest a bathtub water level alarm according to the claimed invention.

U.S. Pat. No. 5,354,050, issued on Oct. 11, 1994 to Robert L. McCarthy, describes a training device comprising a gravity-activated switch which can selectively activate an alarm buzzer. McCarthy does not suggest a bathtub water level alarm according to the claimed invention.

U.S. Pat. No. 5,371,491, issued on Dec. 6, 1994 to Ting K. Wu, describes a multi-functional security apparatus for use in a bathroom or kitchen that includes a water temperature/level sensing unit which activates an alarm when the water level in a bathtub reaches a predetermined level. Wu does not suggest a bathtub water level alarm according to the claimed invention.

U.S. Pat. No. 5,493,877, issued on Feb. 27, 1996 to Daniel R. Wickremasinghe, describes a water level sensor and alarm system for use with a washing machine. Wickremasinghe does not, suggest a bathtub water level alarm according to the invention.

None of the above inventions and patents, taken either singly or in combination, is seen to describe the instant invention as claimed.

SUMMARY OF THE INVENTION

The present invention is a bathtub water level warning device for activating an audible and/or warning indicator when the water level in a bathtub approximately reaches a predetermined level, comprising a water-tight case including a float element, a tubular stem element and a tubular pivot element. The alarm device is an independent device which floats totally free of the bathtub upon the bathtub reaching a filled condition, therefore allowing removal or inclusion of the device in a bathtub as desired by a user, such as during filling only. The float element may be of any desired shape or size. The stem element and the pivot element may be of any desired length and diameter. A power source, a gravity switch, and an audible and/or visible warning indicator is internally mounted in the alarm device. The power source is internally mounted in the pivot element. The gravity switch, such as a mercury switch, and the warning indicator, such as a buzzer or light, are internally mounted in the float element. Gravity causes the switch to close when the alarm device is in a substantially vertical orientation. An electrical circuit connecting the power source, the gravity switch, and the warning indicator activates the warning indicator when the gravity switch is in a closed position caused by the float element rising from a substantially horizontal position (laying in the bathtub) with a resulting vertical attitude of the stem element (floating in the filled bathtub). The user is thus alerted by the warning indicator that the predetermined water level has been approximately reached.

Accordingly, it is a principal object of the invention to provide an independent bathtub water level alarm device which includes a power source, a gravity switch, and an audible and/or visible warning indicator.

It is another object of the invention to activate the warning indicator when the alarm device is in a substantially vertical orientation indicating that the bathtub water level has approximately reached a predetermined level.

It is a further object of the invention to provide an alarm device including a float element, a tubular stem element and a tubular pivot element.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
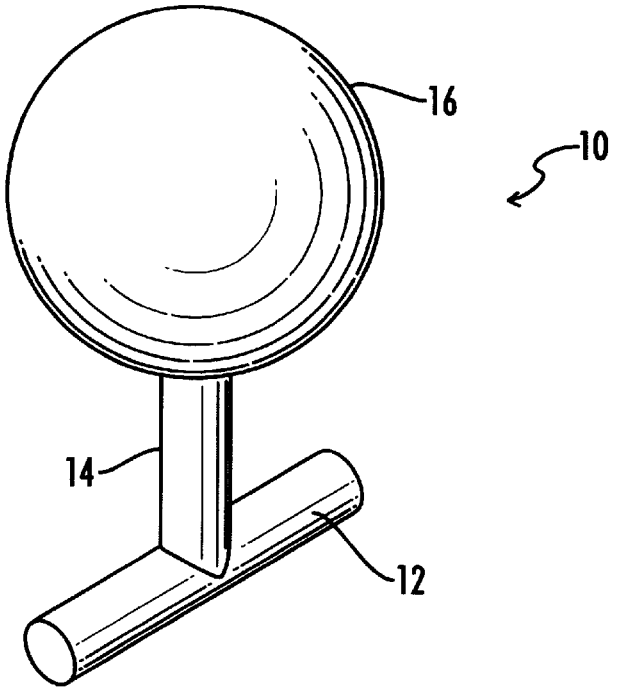
FIG. 1 is a perspective view of a bathtub water level alarm according to the invention.

The bathtub water level alarm device according to the invention is shown generally at 10 in FIGS. 1–4. The alarm device 10 is composed of a water-tight housing with three basic components including a float element 16, a tubular stem element 14, and a tubular pivot element 12. The alarm device 10 is an independent device which is totally free of a bathtub and may be removed or included in a bathtub as desired by a user.

The float element 16 may be of any desired shape or size and is buoyant. The stem element 14 and the pivot element 12 may be of any desired length and diameter and comprise a substantially non-buoyant portion of the device. Furthermore, the float element 16 must be sufficiently buoyant to overcome the weight of the stem element 14 and pivot element 12 to permit the float element to rise and bring the stem element into a vertical attitude. Moreover, the stem element 14 may be length adjustable to permit activation of a warning indicator at different water depths.

A power source 18, a gravity switch 22, and an audible and/or visible warning indicator 20 are internally mounted in the alarm device. The power source 18 is internally mounted in the pivot element 12 with an internally threaded end by means of a threaded water-tight fastening element (not shown). The power source 18 may be any electrical storage device, but preferably includes one or more batteries with large storage capacities such nine volt batteries, thus contributing to the non-buoyant nature of the stem and pivot member portion. The gravity switch 22, such as a mercury switch, and the audible and/or visible warning indicator 20, such as a buzzer or light, are internally mounted in the float element 16. Alternatively, the warning indicator may include a transmitter which transmits a signal to a remote source.

Figure 4:
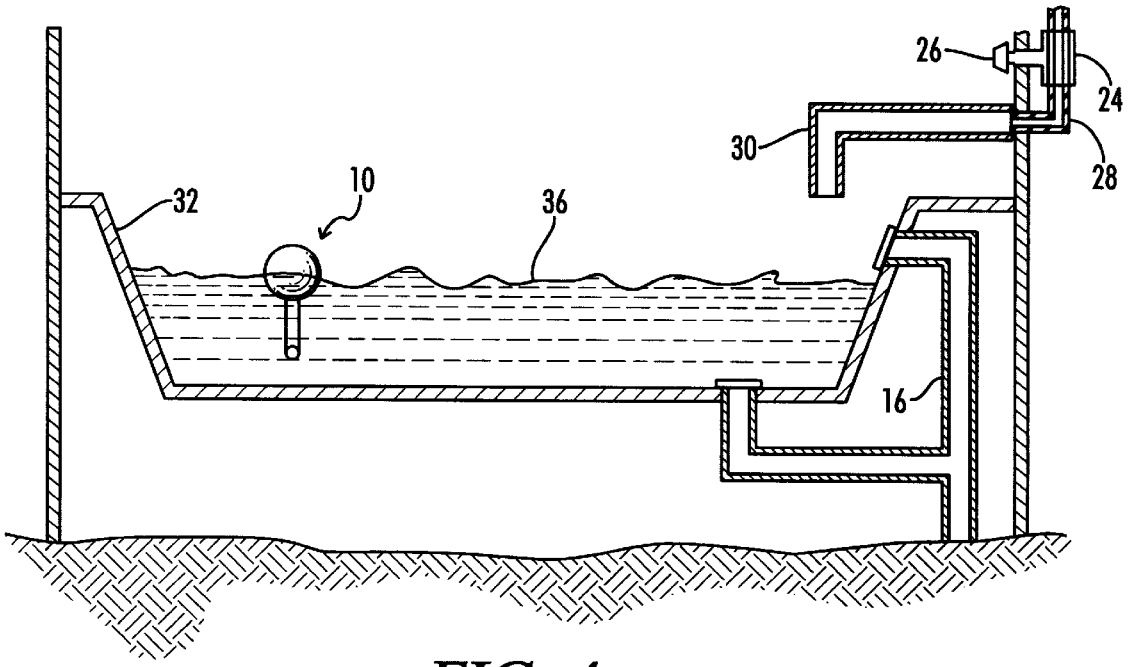
FIG. 4 is a cross-sectional view of the bathtub shown in FIG. 3 with more water and the bathtub water level alarm in an active condition.

In operation, gravity causes the switch 22 to close when the alarm device 10 is in a substantially vertical orientation, as suggested in FIG. 4. An electrical circuit connecting the power source 18, the gravity switch 22, and a warning indicator 20 activates the warning indicator 20 when the gravity switch 22 is in a closed position thereby alerting the user that a predetermined water level has been approximately reached. The optional length adjustable stem element 14 provides the user with a means to adjust the water level height at which the alarm device 10 will activate the warning indicator 20.

Figure 2:
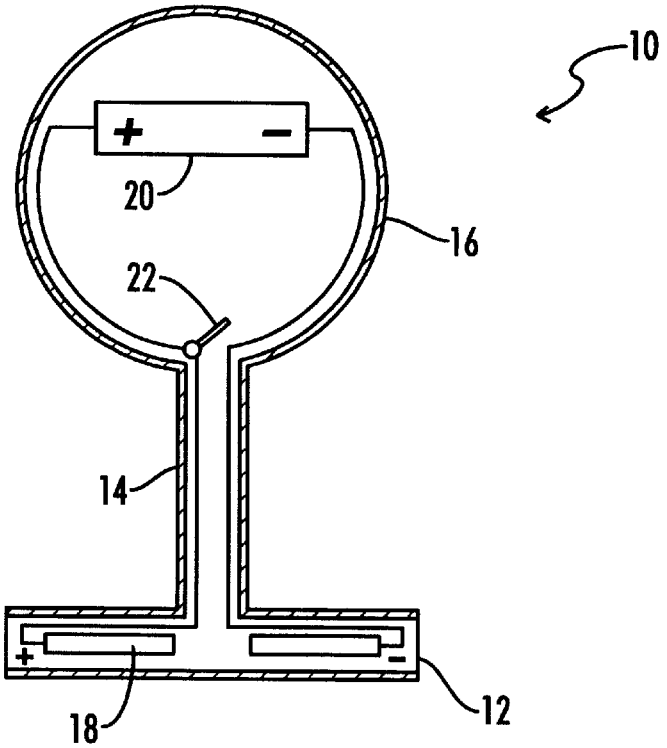
FIG. 2 is a cross-sectional view of the bathtub water level alarm shown in FIG. 1.
Figure 3:
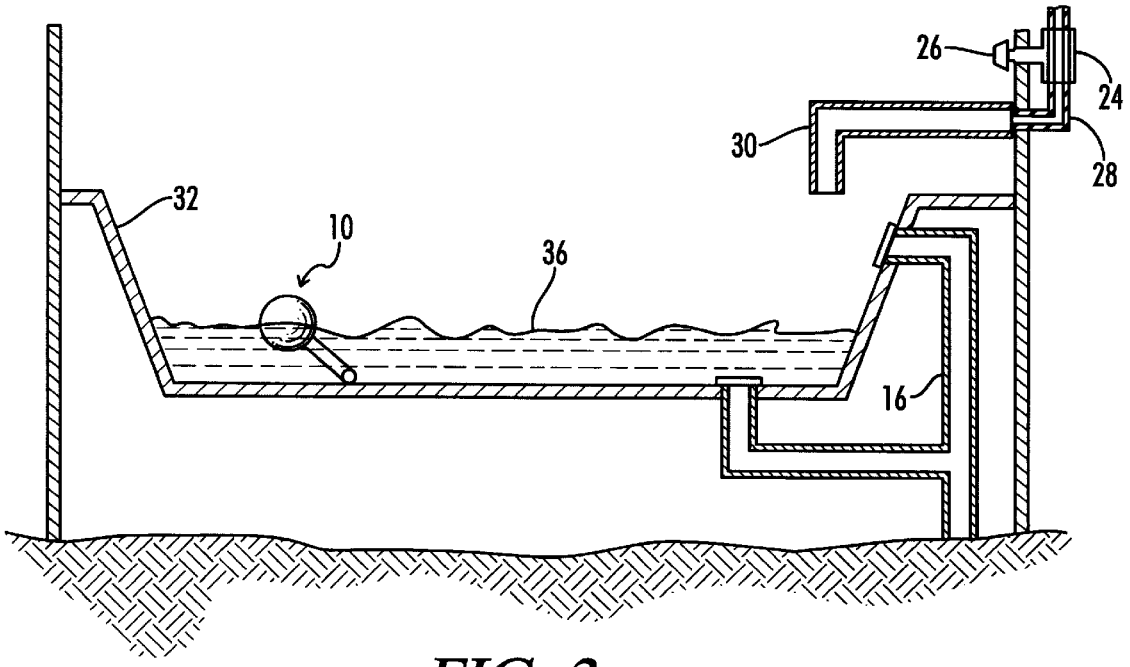
FIG. 3 is a cross-sectional, environmental view of a partially filled bathtub with the bathtub water level alarm shown in FIG. 1 in a non-active condition.

FIGS. 3 and 4 illustrate a cross-sectional view of a bathtub 32 containing the same bathtub water level alarm device 10 shown in FIGS. 1 and 2. The bathtub 32 is of substantially standard construction and includes a faucet 30, a water valve 26, and a drain 16. The water is turned on by means of water valve 26. As the water level rises within bathtub 32 the float element 16 of the alarm device 10 rises and the alarm device 10 becomes more vertically oriented. As shown in FIG. 3, the bathtub water level alarm device 10 is in a non-active condition because the pivot element 12 of the alarm device 10 is not positioned vertically beneath the float element 16 which renders the gravity switch 22 to be open. In FIG. 4, the pivot element 12 is vertically positioned beneath float element 16 which causes gravity switch 22 to close and activate the audible and/or visual warning indicator 20.

It is to be understood that the present invention is not limited to the sole embodiment described above, but encompasses any and all embodiments within the scope of the following claims.

I claim:

1. A bathtub water level alarm device for audibly indicating the rise of water level in a bathtub above a predetermined point, comprising:

a self-contained water-tight case including a float element, a tubular stem element, and a tubular pivot, wherein the case is unanchored and floats independently and totally free of the bathtub element;

a power source internally mounted within to the case;

a gravity switch internally mounted within to the case whereby gravity causes the switch to close when the alarm device reaches a substantially vertical position;

an audible warning indicator internally mounted within the case; and, an electrical circuit internally mounted within the case connecting the power source, the gravity switch, and the audible warning indicator for activating the audible warning indicator when the gravity switch is in a closed position thereby alerting the user that a certain water level has been approximately reached.

2. The bathtub water level alarm device according to claim 1, wherein the tubular stem element includes means for adjusting its length.

3. The bathtub water level alarm device according to claim 1, wherein the audible warning indicator comprises a buzzer.

4. A bathtub water level alarm device for visibly indicating the rise of water level in a bathtub above a predetermined point, comprising:

a self-contained water-tight case including a float element, a tubular stem element, and a tubular pivot element, wherein the case is unanchored and floats independently and totally free of the bathtub;

a power source internally mounted in the pivot element;

a gravity switch internally mounted in the float element which closes when the alarm device reaches a substantially vertical position;

a visible warning indicator internally mounted in the float element; and, an electrical circuit connecting the power source, the gravity switch, and the visible warning indicator for activating the visible warning indicator when the gravity switch is in a closed position thereby alerting the user that a certain water level has been approximately reached.

5. The bathtub water level alarm device according to claim 1, wherein the tubular stem element is length adjustable.

6. The bathtub water level alarm device according to claim 1, wherein the visible warning indicator comprises a light.

7. A bathtub water level alarm device for transmitting a signal to a remote location indicating the rise of water level in a bathtub above a predetermined point, comprising:

a self-contained water-tight case including a float element, a tubular stem element, and a tubular pivot element, wherein the case is unanchored and floats independently and totally free of the bathtub;

a power source internally mounted in the pivot element;

a gravity switch internally mounted in the float element which closes when the alarm device reaches a substantially vertical position;

a transmitter internally mounted in the float element for transmitting a signal to a remote location; and, an electrical circuit connecting the power source, the gravity switch, and the transmitter being activated to transmit the signal to the remote location when the gravity switch is in a closed position thereby indicating to a user that a predetermined water level has been approximately reached.

8. The bathtub water level alarm device according to claim 1, wherein the tubular stem element is length adjustable.

* * * * *